United States Patent [19]

Kubota

[11] 4,433,358

[45] Feb. 21, 1984

[54] TORCH FOR CUTTING, WELDING OR HEATING

[75] Inventor: Yosinori Kubota, Kobe, Japan

[73] Assignee: L'Air Liquide Societe Anonyme pour l'Etude et l'Exploitation des Procedes Georges Claude, Paris, France

[21] Appl. No.: 408,506

[22] Filed: Aug. 16, 1982

[30] Foreign Application Priority Data

| | | | |
|---|---|---|---|
| Aug. 18, 1981 | [JP] | Japan | 56-128969 |
| Feb. 15, 1982 | [JP] | Japan | 57-20504[U] |
| Feb. 26, 1982 | [JP] | Japan | 57-28087[U] |

[51] Int. Cl.[3] ..... F23Q 3/01

[52] U.S. Cl. ..... 361/260

[58] Field of Search ..... 361/252, 247, 258, 260; 431/264, 266

[56] References Cited

U.S. PATENT DOCUMENTS

| | | | |
|---|---|---|---|
| 3,576,471 | 4/1971 | Schumacher | 361/260 |
| 3,947,731 | 3/1976 | Vainer | 361/260 |

*Primary Examiner*—Donald A. Griffin

*Attorney, Agent, or Firm*—Lee C. Robinson, Jr.

[57] ABSTRACT

A torch provided with an automatic igniting device by which the combustible gas mixture needed for cutting, welding or heating metals can be ignited easily, reliably and with proper timing by manipulating a valve which must invariably be opened for feeding the pressure fluid to be used and effectively utilizing the pressure energy of the fluid for ignition. The automatically ignitable torch has outstanding advantages in respect of construction, fabrication, cost and durability.

10 Claims, 5 Drawing Figures

TORCH FOR CUTTING, WELDING OR HEATING

BACKGROUND OF THE INVENTION

The present invention relates to a torch for cutting, welding or heating metals, and more preferably a cutting torch to which the pressure fluid to be used is fed at the highest possible pressure.

For starting a cutting operation, for example, torches are ignited by matches, lighters or like manual devices which are prepared separately. However, when torches, especially those adapted to be held by hand, are to be ignited by such a manual device, the igniting device must be manipulated by one hand with the torch held by the other hand, while a valve must be opened to discharge a combustible gas from the nozzle end for ignition. Thus the overall igniting procedure is very cumbersome. Moreover there is the likelihood of an ignition failure or explosive ignition, or the hazard of causing a burn to the user, depending on the timing and amount of the discharge of the combustible gas.

To overcome these problems, torches have recently been proposed which per se are provided with an automatic igniting device comprising a piezoelectric assembly. Effectively utilizing the pressure energy of the pressure fluid used, the piezoelectric assembly is operated to generate a high voltage, producing a spark at the nozzle end with the electromotive force and automatically igniting a combustible gas flowing out from the nozzle end. A typical example of such torches is disclosed in Published Unexamined Japanese Patent Application No. 68712/1981.

Briefly stated, the disclosed torch, which is designed for cutting, has a nozzle replaceably attached to the head thereof and provided in a fluid channel therein with a piezoelectric element, a striker therefor, a magnet for attracting the striker, lead wires extending to spark electrodes at the forward end of the nozzle and other related parts needed for producing sparks. When valves on pipes for feeding a combustible gas and preheating oxygen gas are opened, the striker in a standby position as held attracted to the magnet is forced away therefrom into percussive contact with the piezoelectric element by the pressure of the resulting combustible gas mixture to generate a high voltage, producing a spark across electrodes at the nozzle end to which the electromotive force is delivered through the lead wires and automatically igniting the combustible mixture flowing out from the nozzle end. Thus the torch can be automatically fired only by opening the valves which are invariably opened for starting a cutting operation. The torch can therefore be ignited much more easily by the above device than by the manual devices conventionally used. The device further has another advantage that the torch can be ignited reliably with proper definite timing at all times.

The disclosed device nevertheless has various drawbacks. The nozzle, which has many parts incorporated therein, is very complex in construction, cumbersome to make and assemble and extremely costly. The pressure of the combustible gas mixture fed is not sufficiently high, while the size of the piezoelectric element is limited by the size of the nozzle, so that the electromotive force is smaller than is desired, consequently entailing the likelihood of ignition failures. Although it appears possible to utilize the pressure of a flow of high-pressure cutting oxygen gas to increase the fluid pressure to be applied to the piezoelectric element, the parts then incorporated in the internal channel of the nozzle for the oxygen gas will impede and disturb the gas flow to result in a reduced cutting efficiency. Moreover, whether the channel having the piezoelectric element incorporated therein is the combustible gas mixture channel or the cutting oxygen gas channel, the element, the magnet, etc., which are positioned close to the fire, tend to become thermally deteriorated early due to the conduction of heat through the nozzle itself. In addition, the nozzle is relatively small generally, most susceptible to the influence of heat and therefore liable to become damaged early. In such an event, the nozzle must be removed from the torch head and replaced by a new one. Thus the nozzle is to be handled as an expendable. The arrangement wherein the automatic igniting device is incorporated in such a nozzle has the drawback of inflicting a great economical loss on the user.

SUMMARY OF THE INVENTION

The present invention provides a cutting, welding or heating torch including automatic igniting means which effectively utilizes the pressure energy of a pressure fluid used and which nevertheless is free of the drawbacks of the foregoing conventional automatic igniting means.

The torch of this invention for cutting, welding or heating is of the type wherein percussion is applied to piezoelectric means within a torch head by the feed pressure of a pressure fluid for generating a high voltage to produce a spark across a pair of spark electrodes at the forward end of a nozzle with the resulting electromotive force and to ignite a combustible gas flowing out from the nozzle end. More specifically the torch comprises a torch head having a pressure fluid channel portion communicating with a pressure fluid channel formed in the nozzle, a piezoelectric assembly fittingly retained within the channel portion of the torch head and having at least one component reciprocatingly movable along the direction of flow of the pressure fluid to produce a high voltage by the application of percussion when moved from a standby position to an operative position by the feed pressure of the pressure fluid and to return to the standby position when the feed of the pressure fluid is discontinued, means for automatically returning the movable component of the piezoelectric assembly from the operative position to the standby position to hold the component in the standby position, and a nozzle composed of inner and outer tubes made of an electroconductive material and individually formed at their forward ends with the pair of electrodes electrically connected to opposite electrodes of the piezoelectric assembly when the nozzle is attached to the torch head.

Although having the advantages due to the use of the automatic igniting means, the torch further has the following advantages resulting from the arrangement wherein the piezoelectric assembly and the means for automatically returning and holding the movable component are housed within the torch head which, as compared with the nozzle, can be diametrically larger, can therefore be machined with greater freedom, is less susceptible to damage and deterioration due to the thermal influence of flames and has higher durability.

(1) The structure of the torch head for incorporating the piezoelectric assembly, etc. therein is less complex than when they are built in the nozzle. This renders the torch in its entirety simpler in construction and easier and less costly to make and assemble.

(2) With no obstacles disposed within the pressure fluid channel of the nozzle, the likelihood of disturbing the flow of the pressure fluid is greatly reduced, enabling the torch to perform cutting or like operation satisfactorily under the contemplated conditions.

(3) A piezoelectric assembly and movable component of increased sizes are usable to afford a greater electromotive force and assure improved ignition performance. This further renders an ignitable gas mixture over an enlarged range of mixing ratios.

(4) The piezoelectric element, magnet, etc. are positioned at a sufficient distance away from flames of high temperature, so that the thermal deterioration of such components can be greatly retarded to give enhanced durability to the overall arrangement.

(5) The piezoelectric assembly, etc. are not incorporated in the nozzle and therefore need not be replaced along with the nozzle, with the result that one piezoelectric assembly, for example, is usable for a plurality of nozzles which are expendables. This lessens the economical burdon on the user.

An object of the present invention is to provide a torch which can be automatically ignited easily and reliably by effectively utilizing the pressure energy of a pressure fluid used, is advantageous in respect of construction, fabrication, cost and durability, and assures the desired work satisfactorily.

Another object of the invention is to provide a torch having a torch head which is greatly simplified in construction by forming an ingeniously designed pressure fluid channel portion therein and through which the pressure fluid is smoothly flowable.

Another object of the invention is to provide a torch in which a piezoelectric assembly and like components are incorporated easily to assure automatic ignition.

Other objects and benefits of the invention will become apparent from the following description.

DESCRIPTION OF THE PREFERRED EMBODIMENTS

Figure 1:
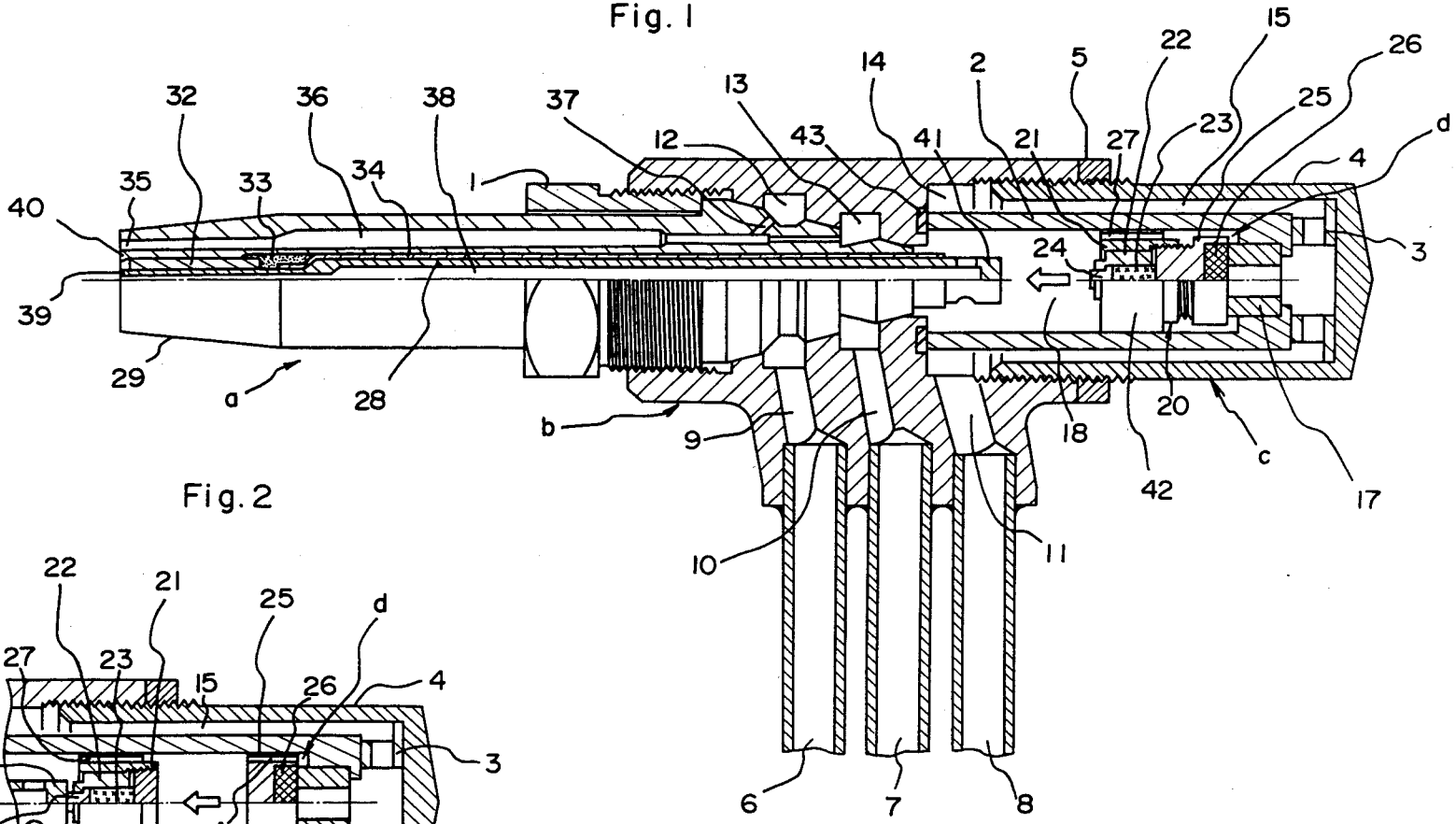
FIG. 1 is a view in vertical section showing a torch according to the invention, with the lower half of its nozzle in elevation.

The present invention will be described below with reference to the preferred embodiments. FIG. 1 shows a cutting gas torch including a torch head b fixedly holding a nozzle a inserted therein from the front and fastened by a nut 1. The nozzle is detachable from the torch head by removing the nut. A unit outer tube 4 having a bottom is coaxially fitted around a unit inner tube 2 for piezoelectric assembly c, with an orifice spacer 3 provided between the rear end of the inner tube 2 and the bottom of the outer tube 4. The front end of the outer tube 4 is screwed in the rear portion of the torch head b to press the front end of the inner tube 2 against the inner rear face of the torch head b, with a packing 43 interposed between the front end and the rear face. The outer tube 4 is held to the torch head b by a lock nut 5.

A combustible gas pipe 6, a preheating oxygen pipe 7 and a cutting oxygen pipe 8 are connected to the torch head b as arranged in parallel from front to rear in the order mentioned. The torch head b is further formed with passageways 9, 10, 11 and annular chambers 12, 13, 14 communicating with the pipes 6, 7, 8 respectively. The annular chamber 14 at the rear end communicates with an annular channel 15 between the unit inner tube 2 and outer tube 4 and further with a bore in a magnetic member 17 through the orifice spacer 3. The magnetic member serves as a tubular valve seat. The interior of the unit inner tube 2 provides a pressure fluid channel 18, i.e. a cutting oxygen channel, for the torch head b. A piezoelectric unit 20 which is a movable component of the piezoelectric assembly c is fittingly retained within the channel 18 of the inner tube 2. The piezoelectric unit 20 is reciprocatingly movable axially of the tube between a standby position and an operative position. The unit 20 comprises a tubular housing 21, an insulator 22, a piezoelectric element 23, a contact member 24, a magnet holder 25 screwed in the rear portion of the housing 21 and a permanet magnet 26 held by the holder 25. The housing 21 is formed in its outer periphery with a multiplicity of small passageways 27 extending axially therethrough and arranged circumferentially thereof. The magnet 26 functions as a valve for preventing cutting oxygen from flowing into the channel 18 when attracted to the magnetic member 17. When the pressure of cutting oxygen forced in exceeds the force of the magnetic attraction, the piezoelectric unit 20 instantaneously abruptly moves forward into striking contact with a nozzle inner tube 28 to generate a high voltage by virtue of a piezoelectric effect. When the feed of cutting oxygen is discontinued, the piezoelectric unit 20 is automatically returned to the standby position by the magnetic attraction. Thus the magnet 26 and the magnetic member 17 provide means d for automatically returning the piezoelectric unit 20 to the standby position and holding the unit 20 in this position.

The nozzle a comprises an outer tube 29 and the above-mentioned inner tube 28 which are both made chiefly of copper and serve also as conductors by which the high voltage generated by the striking contact of the unit 20 is delivered to the forward end of the nozzle a to produce a spark. The nozzle outer tube 29 is completely insulated from the nozzle inner tube 28 by insulators 32, 33 and 34. A plurality of straight channels 36 through which the annular chamber 13 for preheating oxygen communicates with an annular outlet 35 at the nozzle end are formed in the nozzle outer tube 29 by swaging as arranged circumferentially of the tube. The annular chamber 12 for a combustible gas communicates with the straight channels 36 through channels 37. The nozzle inner tube 28 has a cutting oxygen channel 38 which is a pressure fluid channel and which communicates approximately at its rear end with the channel 18 of the unit inner tube 2. The forward end of the nozzle inner tube 28 and the forward end of the nozzle outer tube 29 serve as a pair of electrodes 39 and 40 providing a spark point. Through the torch head b, the unit outer tube 4, the spacer 3 and the unit inner tube 2, the rear half portion of the nozzle outer tube 29 is electrically connected to the housing 21 which is one of the electrodes for the high voltage generated by the piezoelectric unit 20, the rear half portion thus providing an input electrode 42. The rear end of the nozzle inner tube 28 serves as the other input electrode 41 for the high voltage generated by the unit 20.

The torch is ignited in the following manner.

(1) Valves on intermediate portions of the combustible gas pipe 6 and the preheating oxygen pipe 7 are opened.

(2) A valve on an intermediate portion of the cutting oxygen pipe 8 is opened, whereupon the piezoelectric unit 20 strikes the rear end of the nozzle inner tube 28 to generate an electromotive force. Through the nozzle inner tube 28 and the nozzle outer tube 29 which are conductors, the force acts on the spark electrodes 39 and 40 to produce a spark and ignite the combustible gas mixture.

(3) The valve on the cutting oxygen tube 8 is closed, whereupon the piezoelectric unit 20 is automatically returned to the standby position by the magnetic attraction.

Figure 2:
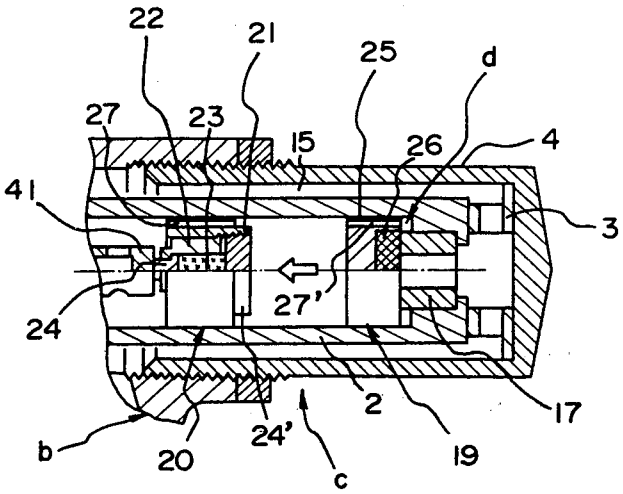
FIG. 2 is a fragmentary view in vertical section showing another embodiment.

FIG. 2 shows a modification of the cutting torch shown in FIG. 1. A piezoelectric unit 20 comprises a piezoelectric element 23, two contact members 24, 24' holding the element therebetween, a tubular housing 21 having a multiplicity of small passageways 27 in its outer periphery, and an insulator 22 electrically insulating the contact member 24 and the piezoelectric element 23 from the housing 21. The piezoelectric unit 20 is held in an operative position so that one of the contact members, 24, is in contact with the input electrode 41 at the rear end of the nozzle inner tube 28 while the other contact member 24' is electrically connected to the nozzle outer tube 29 via the outer periphery of the housing 21, the unit inner tube 2, the orifice spacer 3, the unit outer tube 4 and the torch head b. A striker 19 comprises a nonmagnetic holder 25 having a multiplicity of small passageways 27' in its outer periphery and a magnet 26 held by the holder 25 and is disposed in the channel 18 in the interior of the unit inner tube 2. The striker 19 is reciprocatingly movable between a standby position and the operative position. While in the standby position, the striker 19 functions as a valve for preventing cutting oxygen from flowing into the channel 18. When brought to the operative position, the striker 19 strikes the other contact member 24' of the piezoelectric unit 20. The piezoelectric unit 20 and the striker 19 constitute a piezoelectric assembly c. Because the assembly c comprises the unit 20 and the striker 19 separate therefrom, the unit 20 can be held in the operative position to assure that the opposite electrodes of the piezoelectric unit 20 will be electrically connected to the nozzle inner and outer tubes, respectively, properly at all times. With the exception of the illustrated portion, the modification has the same construction as the torch shown in FIG. 1.

Figure 3:
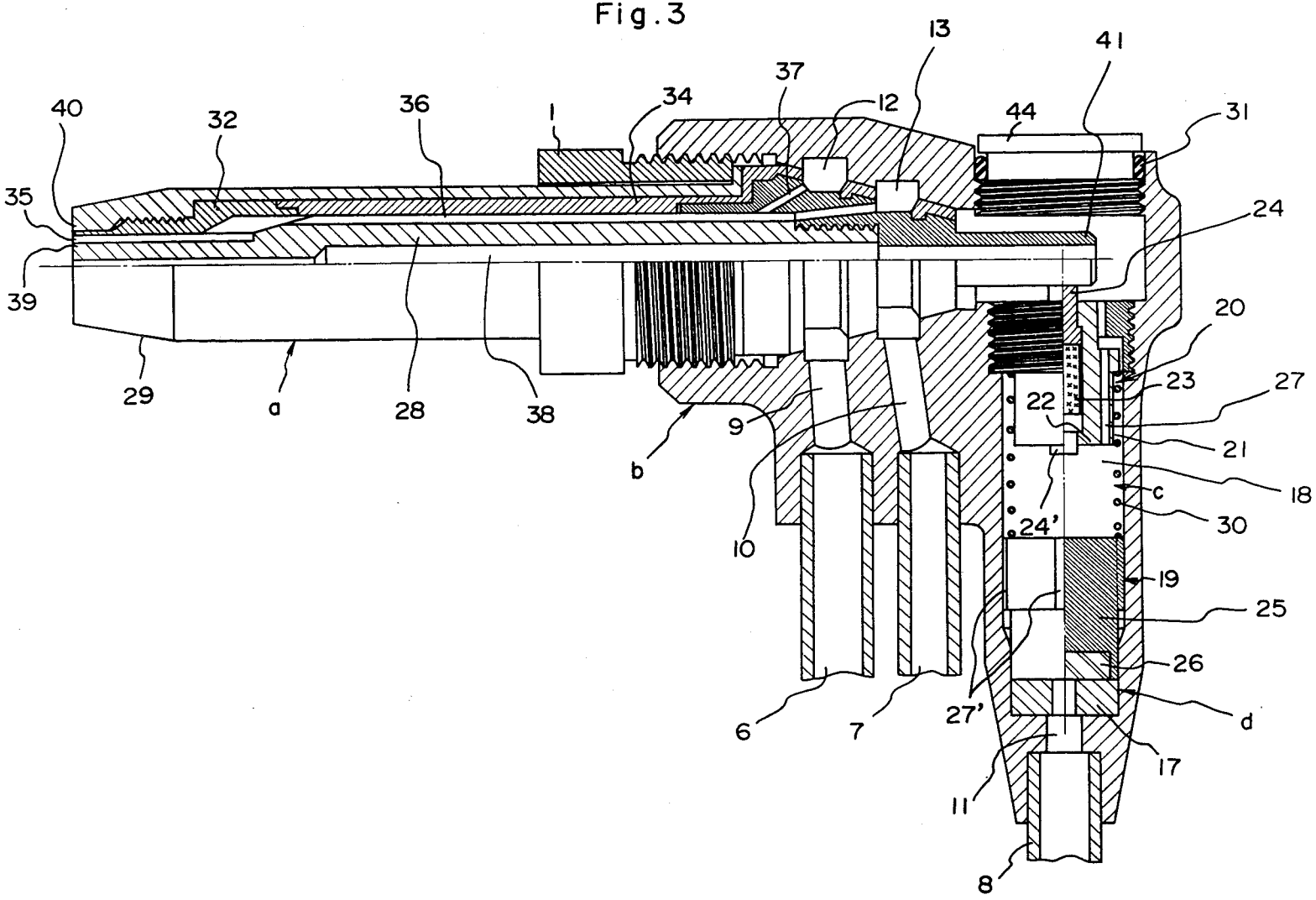
FIG. 3 is a view in vertical section showing another embodiment, with the lower half of its nozzle in elevation.

FIG. 3 shows an improvement of the torch shown in FIG. 2. The foregoing piezoelectric assembly c comprising the piezoelectric unit 20 and the striker 19, and the means d are so improved that the striker 19 is automatically returned from the operative position to the standby position and held in the latter position by the cooperation of the force of magnetic attraction and the resilient restoring force of a coil spring 30 additionally provided. Furthermore, the torch head b is substantially L-shaped in its entirety so that the cutting oxygen channel 18 directly formed in the torch head b itself for fittingly retaining the means d therein is positioned exactly or approximately at a right angle to the cutting oxygen channel 38 of the nozzle a. The channel 18 of the torch head b is open at one end thereof opposite to the other end connected to the cutting oxygen pipe 8, and the assembly c and the means d can be incorporated into the channel 18 through the opening. After assembly, a cap 44 having an O-ring 31 is screwed into the open end to hermetically close the opening. Although other portions relating to the change in the position of the channel 18 are slightly modified, the present embodiment has substantially the same construction as those shown in FIGS. 1 and 2 with the exception of the above features, so that throughout FIGS. 1 to 3 like parts are referred to by like reference numerals without giving a detailed description.

The unit inner and outer tubes shown in FIGS. 1 and 2 and projecting rearward are omitted from the embodiment of FIG. 3. The torch head therefore has a simple shape almost resembling the shape of conventional ones. The present embodiment thus has the advantage of being simple in construction and easy to fabricate and another advantage that the cutting oxygen flows smoothly without detouring.

Figure 4:
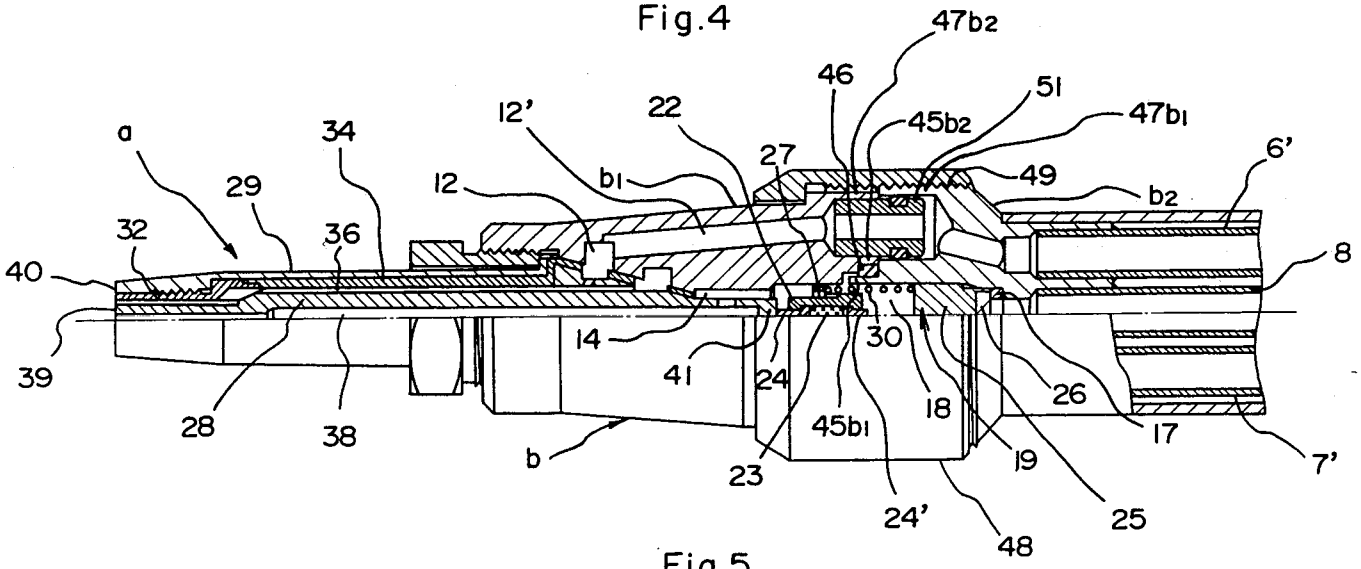
FIG. 4 is an elevational view showing another embodiment as assembled in condition for use, with the upper half thereof in vertical section.
Figure 5:
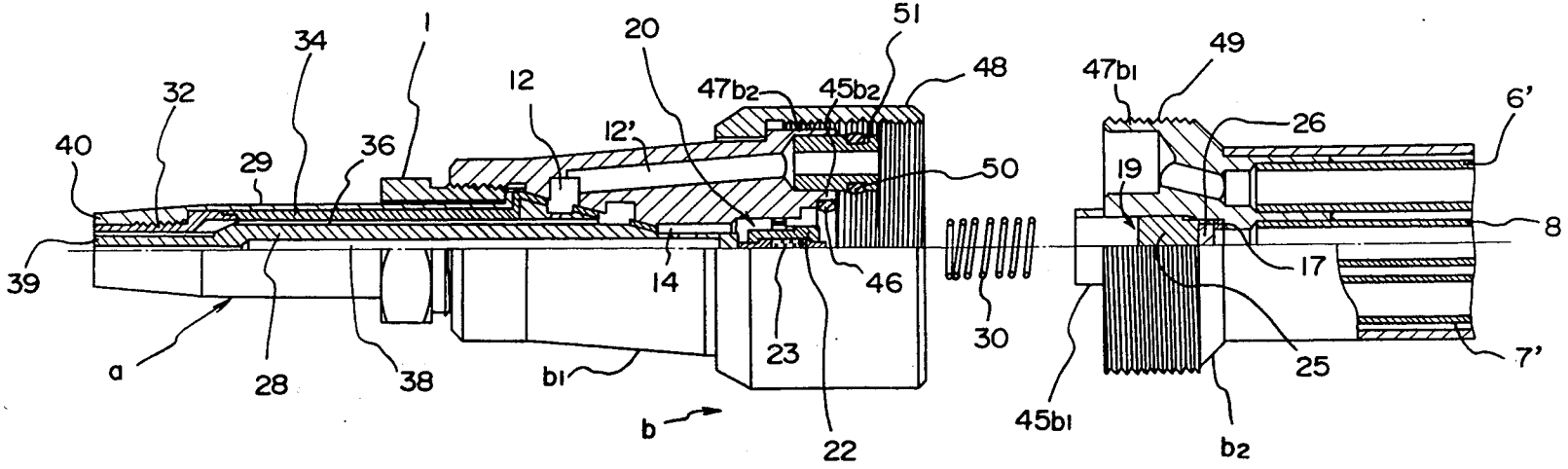
FIG. 5 is an exploded elevational view of the same embodiment, with its upper half shown in vertical section.

FIGS. 4 and 5 show a cutting torch for an automatic cutter including a torch head b having incorporated therein the piezoelectric assembly c shown in FIG. 2. Gas feed pipes 6', 7', 8 are connected to a combustible gas channel 12', a preheating oxygen channel and a cutting oxygen channel 18 formed in the head b, respectively substantially in alignment therewith. The torch head b having the assembly c and the means d for automatically returning the striker 19 is divided, at a plane close to one end of the insulator 22 on the piezoelectric element 23 and perpendicular to the direction of flow of cutting oxygen, into a segment $b_1$ closer to the nozzle and fixedly holding the piezoelectric unit 20 therein and a segment $b_2$ closer to the feed pipes and movably retaining the striker 19 therein. The divided head segments $b_1$ and $b_2$ are detachably connected together, such that inner wall portions 45$b_1$ and 45$b_2$ are fitted to each other hermetically and coaxially with an annular packing 46 provided therebetween and that outer wall portions 47$b_1$ and 47$b_2$ are fitted to each other by a fastening member 48 resembling a cap nut, externally held to one of these portions and screwed on an externally threaded outer peripheral portion 49 of the other portion. Indicated at 51 is a seal member. The dividing line of the head segments $b_1$ and $b_2$ is stepped as seen in FIGS. 4 and 5 in order to make these segments fixedly connectable easily and to effectively seal off the junctions of the channels. The seal member 51 having an O-ring or like seal 50 therearound also assures this advantageously.

With the embodiment shown in FIGS. 4 and 5, the axial dimension of the cutting oxygen channel in the torch head which permits the installation of the piezoelectric assembly c and the automatic returning means d into the channel can be reduced by up to one half of the corresponding dimension of the conventional device, so that these assembly and means can be incorporated with great ease, with the parts assembled properly as positioned accurately, to assure the generation of high voltage and ignition as contemplated. In addition, the parts can be inspected, repaired and replaced for maintenance very advantageously. Thus the torch has various advantages.

The present invention is also applicable to welding torches or heating torches. In this case, a fuel gas or preheating oxygen is used as the pressure fluid.

What we claim is:

1. A cutting, welding or heating torch wherein percussion is applied to piezoelectric means within a torch head by the feed pressure of a pressure fluid for generating a high voltage to produce a spark across a pair of spark electrodes at the forward end of a nozzle with the resulting electromotive force and to ignite a combustible gas flowing out from the nozzle end, the nozzle having a pressure fluid channel formed therein, the torch comprising:

the torch head having a pressure fluid channel portion communicating with the pressure fluid channel formed in the nozzle, a piezoelectric assembly including a first pair of electrodes, the piezoelectric assembly being fittingly retained within the channel portion of the torch head and having at least one component reciprocatingly movable along the direction of flow of the pressure fluid to produce a high voltage by the application of percussion when moved from a standby position to an operative position by the feed pressure of the pressure fluid and to return to the standby position when the feed of the pressure fluid is discontinued, means for automatically returning the movable component of the piezoelectric assembly from the operative position to the standby position to hold the component in the standby position, and the nozzle being composed of an inner tube and an outer tube made of an electroconductive material and individually formed at their forward ends with a second pair of electrodes respectively connected to the first pair of electrodes of the piezoelectric assembly when the nozzle is attached to the torch head.

2. A cutting, welding or heating torch as defined in claim 1 wherein the movable component is a piezoelectric unit included in the piezoelectric assembly.

3. A cutting, welding or heating torch as defined in claim 1 wherein the movable component functions as a valve for preventing the pressure fluid from flowing into the pressure fluid channel portion of the torch head when in the standby position, the movable component being electrically connected to the inner tube of the nozzle when in the operative position.

4. A cutting, welding or heating torch as defined in claim 1 wherein the means for automatically returning the movable component of the piezoelectric assembly to the standby position to hold the component in the standby position comprises a permanent magnet.

5. A cutting, welding or heating torch as defined in claim 1 wherein the piezoelectric assembly comprises a piezoelectric element, a tubular housing having a multiplicity of pressure fluid passageways in its outer periphery and serving as one of the electrodes of the piezoelectric assembly, a contact member in contact with the piezoelectric element so as to be subjected to the percussion in the operative position and serving as the other electrode of the piezoelectric assembly, a magnet holder adjacent the housing, a magnet held by the holder for preventing the pressure fluid from flowing into the pressure fluid channel portion of the torch head when held attracted in the standby position, and an insulator for electrically insulating the piezoelectric element and the contact member from the housing.

6. A cutting, welding or heating torch as defined in claim 1 wherein the piezoelectric assembly comprises a piezoelectric unit held in the operative position, a striker composed of a magnet holder having a first multiplicity of pressure fluid passageways in its outer periphery and a magnet held by the holder, the piezoelectric unit comprising a piezoelectric element, two contact members holding the piezoelectric element therebetween and serving as the electrodes of the piezoelectric assembly, a tubular housing having a second multiplicity of pressure fluid passageways in its outer periphery and an insulator electrically insulating the piezoelectric element and one of the contact members from the housing, the striker being reciprocatingly movable between the standby position and the operative position to serve as a valve for preventing the pressure fluid from flowing into the pressure fluid channel portion of the torch head when held attracted in the standby position and to strike the piezoelectric unit when brought to the operative position.

7. A cutting, welding or heating torch as defined in claim 5 or 6 wherein the pressure fluid channel portion of the torch head has the piezoelectric assembly fittingly retained therein and is positioned at approximately a right angle to the pressure fluid channel of the nozzle.

8. A cutting, welding or heating torch as defined in claim 6 wherein the torch head includes a first segment for feeding the pressure fluid and retaining the striker therein reciprocatingly movably, and a second segment positioned between the first segment and the nozzle and holding the piezoelectric unit in a fixed position, the torch head segments being detachably connected to each other.

9. A cutting, welding or heating torch comprising, in combination:

a nozzle having concentric tubular members with discharge ends forming a first pair of electrodes;

a piezoelectric assembly disposed within the pressure fluid channel portion of the torch head, the piezoelectric assembly including a second pair of electrodes respectively connected to the electrodes in said first pair and percussion means movable within said pressure fluid channel portion from a standby position to an operative position in response to the application of fluid pressure to said channel portion, said percussion means producing a high voltage across said second pair of electrodes upon the movement of the percussion means to said operative position to thereby form a spark across said first pair of electrodes; and means for automatically returning the percussion means from its operative position to its standby position.

10. A cutting, welding or heating torch as defined in claim 9, wherein the automatically returning means comprises a spring.

* * * * *